US005975669A

United States Patent [19]

Ohshima

[11] Patent Number: 5,975,669

[45] **Date of Patent: *Nov. 2, 1999**

[54] INK-JET RECORDING APPARATUS AND RECORDING METHOD

[75] Inventor: Noriyoshi Ohshima, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/423,103

[22] Filed: Apr. 18, 1995

[30] Foreign Application Priority Data

Apr. 22, 1994 [JP] Japan ..... 6-084495

[51] Int. Cl.[6] ..... B41J 29/38

[52] U.S. Cl. ..... 347/14

[58] Field of Search ..... 347/14, 17, 60, 347/133, 189, 191, 194

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,066,961 | 11/1991 | Yamashita | 346/76 |
| 5,315,316 | 5/1994 | Khormaee | 346/1.1 |
| 5,339,098 | 8/1994 | Nagatomo et al. . | |
| 5,343,231 | 8/1994 | Suzuki | 347/14 |
| 5,361,090 | 11/1994 | Suzuki et al. | 347/17 |
| 5,365,257 | 11/1994 | Minowa et al. | 346/76 |
| 5,485,182 | 1/1996 | Takayanagi et al. | 347/17 |
| 5,559,535 | 9/1996 | Otsuka et al. | 347/14 |
| 5,576,745 | 11/1996 | Matsubara | 347/14 |
| 5,604,526 | 2/1997 | Kwak | 347/191 |

FOREIGN PATENT DOCUMENTS

| | | |
|---|---|---|
| 0505154 | 9/1992 | European Pat. Off. . |
| 0626261 | 11/1994 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

An ink-jet recording apparatus includes a characteristics detection circuit for detecting temperature characteristics of a recording head based on a temperature change when the recording head is heated, an ambient-temperature detection circuit for detecting an ambient temperature, and a control circuit for controlling an amount of ink discharge of the recording head based on the detected temperature characteristics and ambient temperature. It is thereby possible to obtain an appropriate recording density.

22 Claims, 21 Drawing Sheets

FIG.10

| TEMPERATURE RISE | T1~T2 | T2~T3 | T3~T4 |
|---|---|---|---|
| TEMPERATURE CHARACTERISTICS | H3 | H2 | H1 |

FIG.11

| AMBIENT TEMPERATURE [°C] / TEMPERATURE CHARACTERISTICS | 10 | 11 | 12 | 13 | 14 | 15 | 16 | 17 | 18 | 19 | 20 |
|---|---|---|---|---|---|---|---|---|---|---|---|
| H1 | t1 | t11 | t12 | t13 | t14 | t15 | t16 | t17 | t18 | t19 | 0 |
| H2 | t2 | t21 | t22 | t23 | t24 | t25 | t26 | t27 | t28 | t29 | 0 |
| H3 | t3 | t31 | t32 | t33 | t34 | t35 | t36 | t37 | t38 | t39 | 0 |

HEATING PERIOD

FIG.17

| TEMPERATURE RISE | T5~T6 | T6~T7 | T7~T8 |
|---|---|---|---|
| TEMPERATURE CHARACTERISTICS | H6 | H5 | H4 |

FIG.18

| AMBIENT TEMPERATURE [°C] / TEMPERATURE CHARACTERISTICS | 10 | 11 | 12 | 13 | 14 | 15 | 16 | 17 | 18 | 19 | 20 |
|---|---|---|---|---|---|---|---|---|---|---|---|
| H4 | t4 | t41 | t42 | t43 | t44 | t45 | t46 | t47 | t48 | t49 | 0 |
| H5 | t5 | t51 | t52 | t53 | t54 | t55 | t56 | t57 | t58 | t59 | 0 |
| H6 | t6 | t61 | t62 | t63 | t64 | t65 | t66 | t67 | t68 | t69 | 0 |

INK-JET RECORDING APPARATUS AND RECORDING METHOD

BACKGROUND OF THE INVENTION

1. Field of the Invention

This invention relates to an ink-jet recording apparatus and recording method which can be applied to a recording apparatus, such as a printer, a facsimile apparatus, a word processor, a copying apparatus or the like. More particularly, the invention relates to an ink-jet recording apparatus and recording method for controlling the temperature and the amount of ink discharge of a recording head.

2. Description of the Related Art

Recording apparatuses in which recording is performed on a recording medium, such as paper, an OHP (overhead projector) sheet or the like, have been practically used by mounting recording heads of various kinds of recording methods. The recording methods comprise, for example, a wire dot method, a thermal printing method, a thermal transfer method, an ink-jet method, and the like. In the ink-jet method, recording is performed by discharging ink from a recording head onto a recording medium. This method has attracted notice as a quiet recording method with a low running cost.

However, the amount of ink discharge in the ink-jet method generally has temperature dependency, so that the recording density changes depending on the ambient temperature and the like. This is because the physical properties, particularly the viscosity, of ink change depending on the ambient temperature. At low temperatures, it is difficult to discharge ink because the viscosity of the ink increases. On the other hand, at high temperatures, ink can be easily discharged because the viscosity of the ink decreases. Accordingly, in order to provide an appropriate amount of ink discharge, various methods have been adopted for controlling the temperature of the recording head.

As disclosed in U.S. Pat. No. 5,339,098, two principal control methods are considered for controlling the temperature of the recording head. In one of the methods, a heater provided at the recording head is used as control means such that the recording head is heated to an appropriate temperature at a low temperature. In another method, an ink discharging heater is used as control means such that ink is preliminarily heated at a low temperature, or the heat when the ink is discharged is controlled.

In a control method of these control means, it is theoretically desirable to detect the temperature of the recording head to be controlled, and to perform feedback control in a closed loop. In this case, however, problems often arise in the detection of the temperature of the recording head. In general, the temperature of the recording head is detected using a thermistor, a thermocouple or the like as a temperature sensor in which the value of electrical resistance or an electromotive force changes depending on the temperature. At that time, the relationship between a reference temperature and the output value of the temperature sensor differs for each temperature sensor due to variations in produced temperature sensors. Therefore, some kinds of countermeasures must be taken in order to detect an actual temperature.

In a simplest approach, only temperature sensors whose outputs are within a predetermined range with respect to a reference temperature are selected and are used without performing adjustment. This approach, however, has a great disadvantage in that the cost of the temperature sensor very much increases. In another approach, temperature sensors are ranked according to output values with respect to a reference temperature, and ranked temperature sensors are used by changing a conversion reference in accordance with a rank. Such an approach, however, also requires a considerable number of operations, such as measurement of ranks in the production process of recording heads, display of ranks, manual adjustment in an assembling process of apparatuses, mounting of means for automatically identifying ranks in a recording apparatus, and the like.

Accordingly, in general, the temperature of a recording head is controlled by performing open-loop sequence control without detecting the temperature of the recording head.

In the open-loop sequence control, it is desirable to perform thermal analysis of the recording head to be controlled, and to perform control based on the result of the analysis. Actually, however, it is rather difficult to realize such an approach. Practically, data relating to the temperature and the amount of ink discharge of the recording head to be controlled when various kinds of control inputs are provided to control means of the control system is obtained, and control is performed based on the obtained data. The obtained data have different values depending on temperature characteristics of the recording head. Accordingly, for example, control inputs are set to average values of respective recording heads by statistically processing the data.

However, the above-described conventional approach has the following problems.

When setting the control inputs to average values of respective recording heads, although no problem arises when only small variations are present in temperature characteristics of produced recording heads, the objects of control will not be achieved and recording heads will, in some cases, be operated under worse conditions when large variations are present in temperature characteristics of recording heads. In such a case, it is necessary to control temperature characteristics of recording heads by an approriate method.

In another approach, taking into consideration variations in temperature characteristics of produced recording heads, control inputs are set to small values so that the recording heads are not operated under worse conditions irrespective of temperature characteristics. In such a case, however, little control effects will, in some cases, be obtained for certain recording heads because the control inputs are set to small values.

SUMMARY OF THE INVENTION

The present invention has been made in consideration of the above-described problems.

It is an object of the present invention to provide an ink-jet recording apparatus and recording method in which an appropriate recording density can be obtained irrespective of variations in temperature characteristics of produced recording heads.

It is another object of the present invention to provide an ink-jet recording apparatus and recording method in which recording can be performed with an appropriate density irrespective of variations in the ambient temperature.

According to one aspect, the present invention, which achieves these objectives, relates to an ink-jet recording apparatus for performing recording using a recording head for discharging ink onto a recording medium, comprising ambient-temperature detection means for detecting an ambient temperature, heating means provided in the recording head, recording-head-temperature detection means for detecting a temperature of the recording head, temperature-characteristics detection means for detecting temperature characteristics of the recording head based on a result of detection of a temperature change in the recording head caused by predetermined energy applied to the heating means by the recording-head-temperature detection means, and discharge-amount control means for controlling an amount of ink discharge of the recording head based on the temperature characteristics of the recording head detected by the temperature-characteristics detection means and the ambient temperature detected by the ambient-temperature detection means.

According to another aspect, the present invention relates to an ink-jet recording method for performing recording using a recording head for discharging ink onto a recording medium, comprising the steps of measuring a first temperature of the mounted recording head, heating the recording head by driving heating means of the mounted recording head, measuring a second temperature of the mounted recording head after starting the heating, detecting temperature characteristics of the recording head based on the measured first and second temperatures of the recording head, detecting an ambient temperature, and performing recording in a state of controlling an amount of ink discharge of the recording head based on the detected temperature characteristics of the recording head and the detected ambient temperature.

In the present invention, by detecting temperature characteristics of a recording head and controlling an amount of ink discharge of the recording head based on the detected temperature characteristics of the recording head and the ambient temperature, an appropriate recording density can be maintained within a guaranteed ambient temperature range irrespective of variations in temperature characteristics of recording heads.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 10 is a diagram illustrating a correspondence table between temperature rise and temperature characteristics of a recording head in the first embodiment;

FIG. 11 is a diagram illustrating a table for determining a driving time period for the heater in accordance with the ambient temperature and the temperature characteristics of the recording head in the first embodiment;

FIG. 17 is a diagram illustrating a correspondence table between temperature rise and temperature characteristics of a recording head in the second embodiment;

FIG. 18 is a diagram illustrating a table for determining a time period of application of a prepulse when driving a discharging heater in accordance with the ambient temperature and the temperature characteristics of the recording head in the second embodiment;

DETAILED DESCRIPTION OF THE PREFERRED EMBODIMENTS

Preferred embodiments of the present invention will now be described in detail with reference to the drawings.

First, a description will be provided of an ink-jet recording head to which the present invention can be applied.

Figure 1:
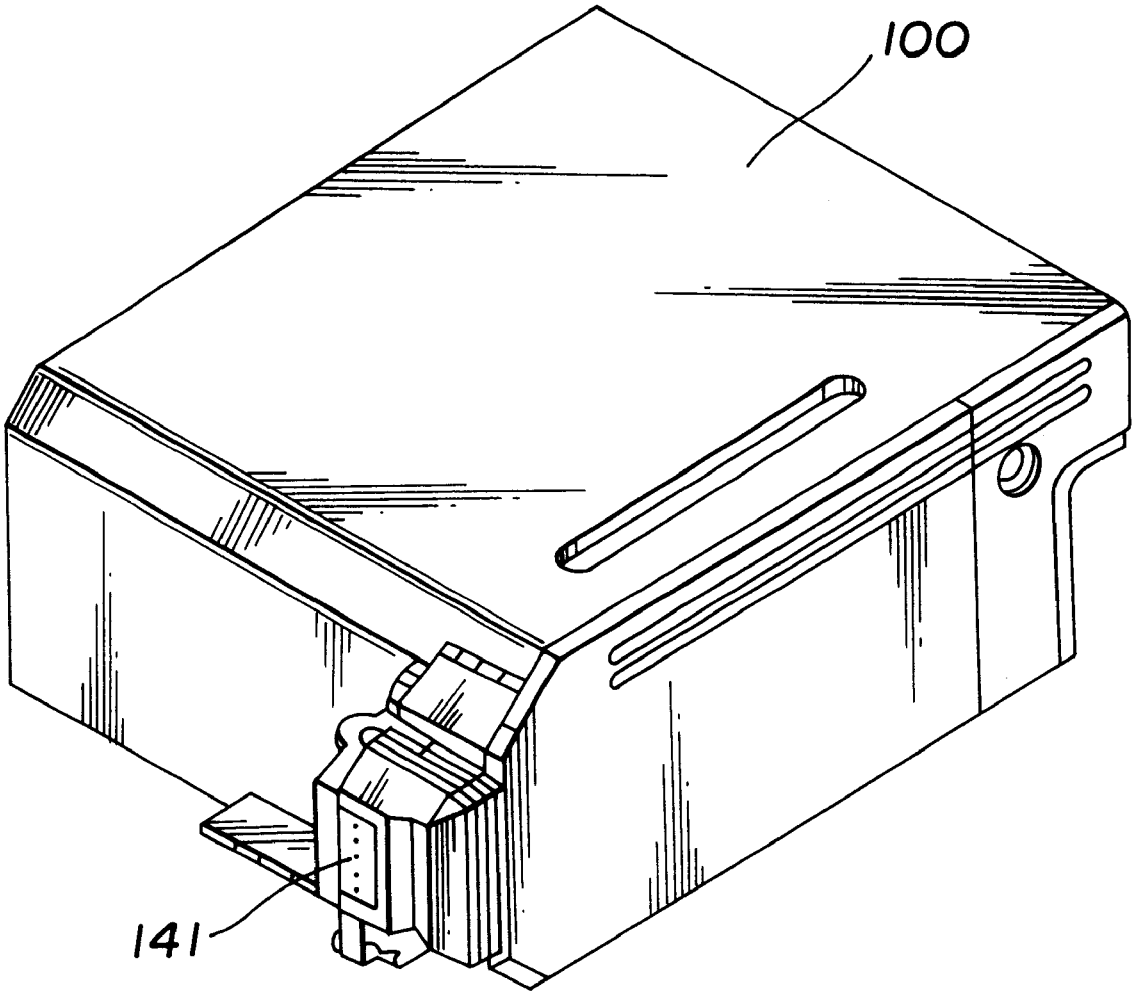
FIG. 1 is a perspective view illustrating a head cartridge to which the present invention can be applied.
Figure 2:
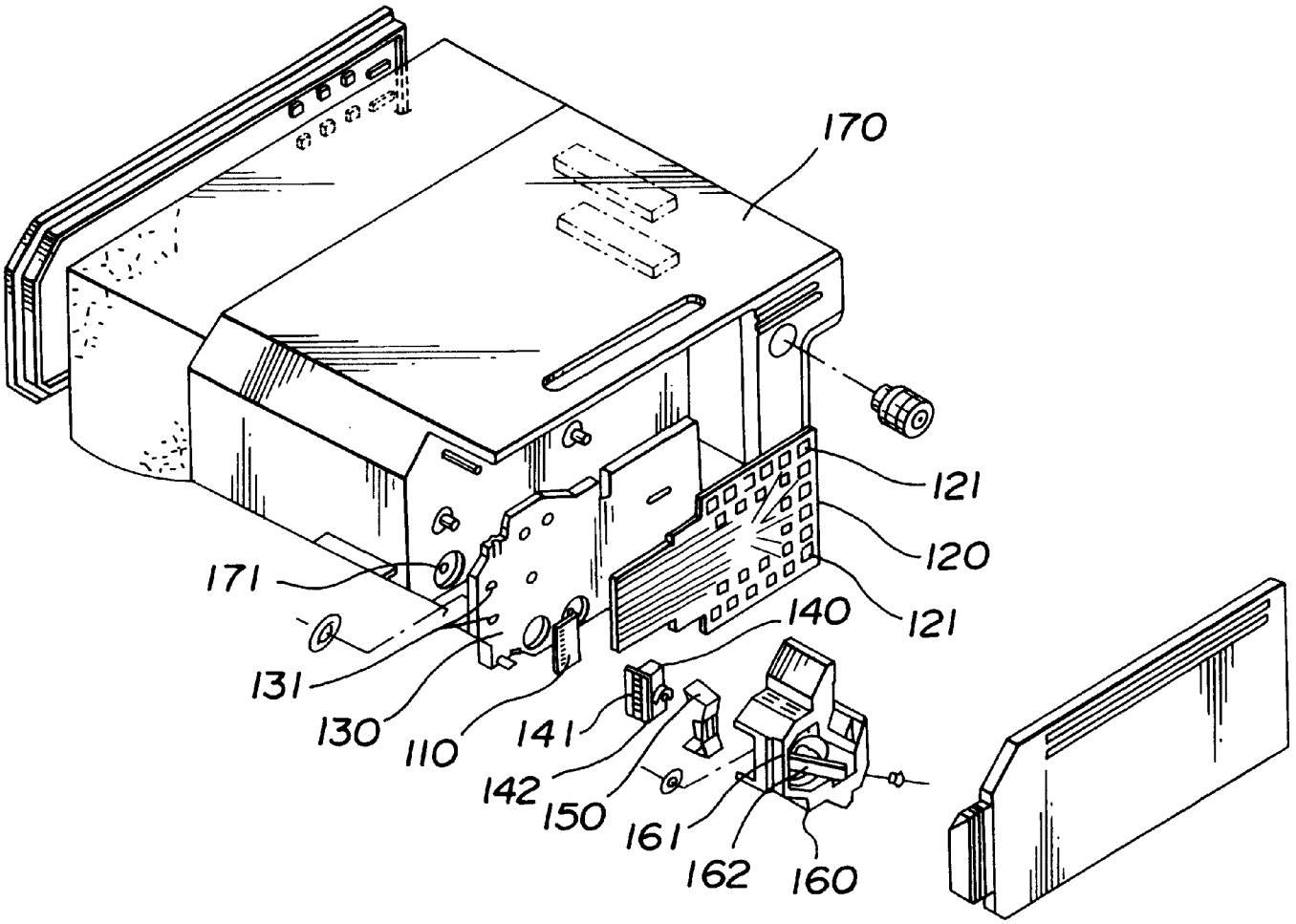
FIG. 2 is an exploded perspective view of the head cartridge shown in FIG. 1.

FIG. 1 is a perspective view of a head cartridge 100 provided by integrating a recording head and an ink tank. FIG. 2 is an exploded perspective view of the head cartridge 100.

In FIG. 2, a plurality of discharging heaters arranged in a line on an Si substrate, electrical interconnection for supplying them with electric power, and the like are formed on a heater board 110. A grooved top plate 140 includes an orifice plate 141 having a plurality of nozzles and discharging ports corresponding thereto, a common liquid chamber for accommodating ink to be supplied to the nozzles, and the like formed as one body. Terminals of interconnection of an interconnection substrate 120 provided at one end thereof are connected to the heater board 110 by wire bonding or the like, and pads 121 for receiving electrical signals from the main body of a recording apparatus are provided at another end of the interconnection substrate 120. The interconnection substrate 120 and the heater board 110 are bonded to a metallic base plate 130 using an adhesive or the like. By grasping the heater board 110 and the grooved top plate 140 by a pressing spring 150 and fitting a leg portion of the pressing spring 150 into a hole 131 of the base plate 130, the heater board 110 and the grooved top plate 140 are fixed to the base plate 130 while being pressed. An ink supply member 160 includes an ink supply tube 161 and an ink conduit 162 connected thereto. The ink supply tube 161 is connected to an ink supply hole 171 of an ink tank 170, and the ink conduit 162 is connected to an ink socket 142 of the grooved top plate 140. Thus, an ink channel from the ink tank 170 to the discharging ports of the orifice plate 141 is formed.

Figure 3:
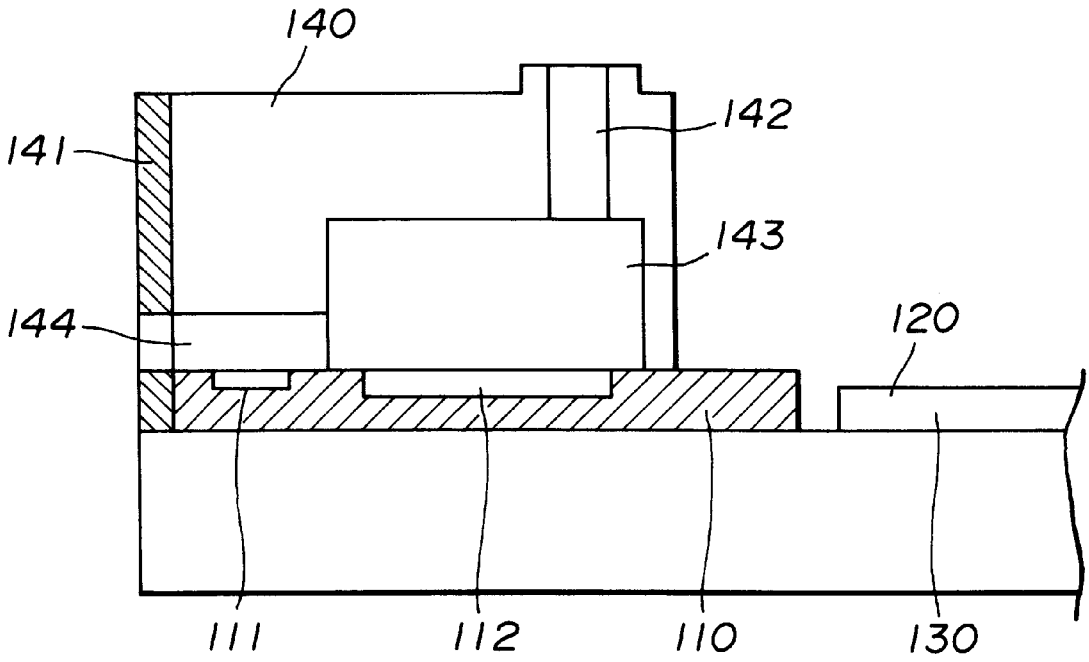
FIG. 3 is a schematic cross-sectional view illustrating the proximity of a nozzle of the head cartridge shown in FIG. 1.

FIG. 3 is a schematic cross-sectional view illustrating the proximity of one of the nozzles of the head cartridge 100. In FIG. 3, reference numeral 144 represents the nozzle, and reference numeral 143 represents the common liquid chamber.

Figure 4A:
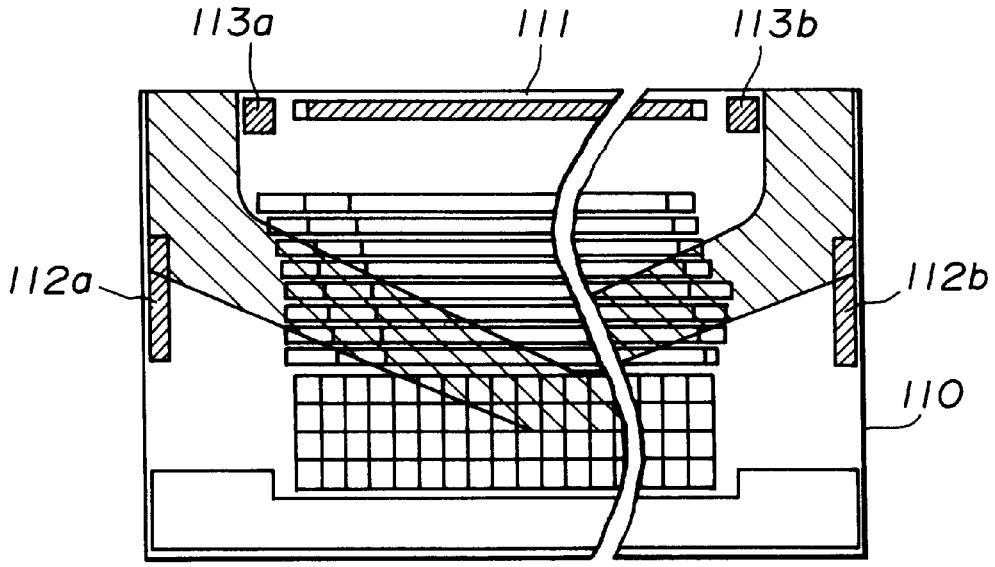
FIG. 4(A) is a top plan view of a heater board.
Figure 4B:
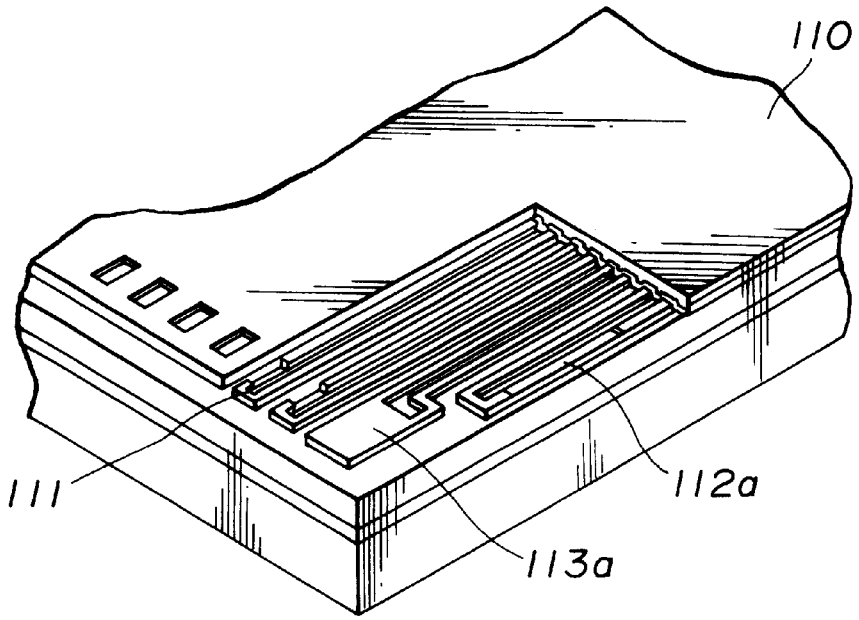
FIG. 4(B) is a diagram illustrating the detail of a principal portion of the heater board shown in FIG. 4(A)

FIGS. 4(A) and 4(B) illustrate the heater board 110: FIG. 4(A) is a top plan view thereof; and FIG. 4(B) is a diagram illustrating the details of a principal portion of the heater board 110. In FIGS. 4(A) and 4(B), discharging heaters 111 are provided for the corresponding nozzles connected to the discharging ports of the orifice plate 141. By applying a voltage to the discharging heater 111, ink in the corresponding nozzle 144 obtains thermal energy and is discharged from the corresponding discharging port of the orifice plate 141 as a droplet, whereby recording is performed. Heaters (sub-heaters) 112*a* and 112*b* can heat the proximity of the heater board 110. Temperature sensors 113*a* and 113*b*, capable of being produced by a semiconductor film forming technique simultaneously as the discharging heaters 111 and the heaters 112*a* and 112*b*, can detect a temperature change in the proximity of the nozzles 144 of the recording head. Hatched portions indicate portions connected to the grooved top plate 140. The discharging heater 111 is an electrothermal transducer, having a resistance value of 120 Ω, which outputs energy of about 3 W with a driving voltage of 19 V. The heater 112 is an electrothermal transducer, having a resistance value of 144 Ω, which outputs energy of 4 W with a driving voltage of 24 V. The temperature sensor 113 is a diode sensor, whose output voltage value changes by about 2.5 mV (this value (amount of change) being substantially constant irrespective of recording heads because this value is determined by the physical property of the sensor) for a temperature change of one degree at a current of 200 $\mu$A.

Next, a description will be provided of a printer of an ink-jet recording apparatus which uses the above-described head cartridge.

Figure 5:
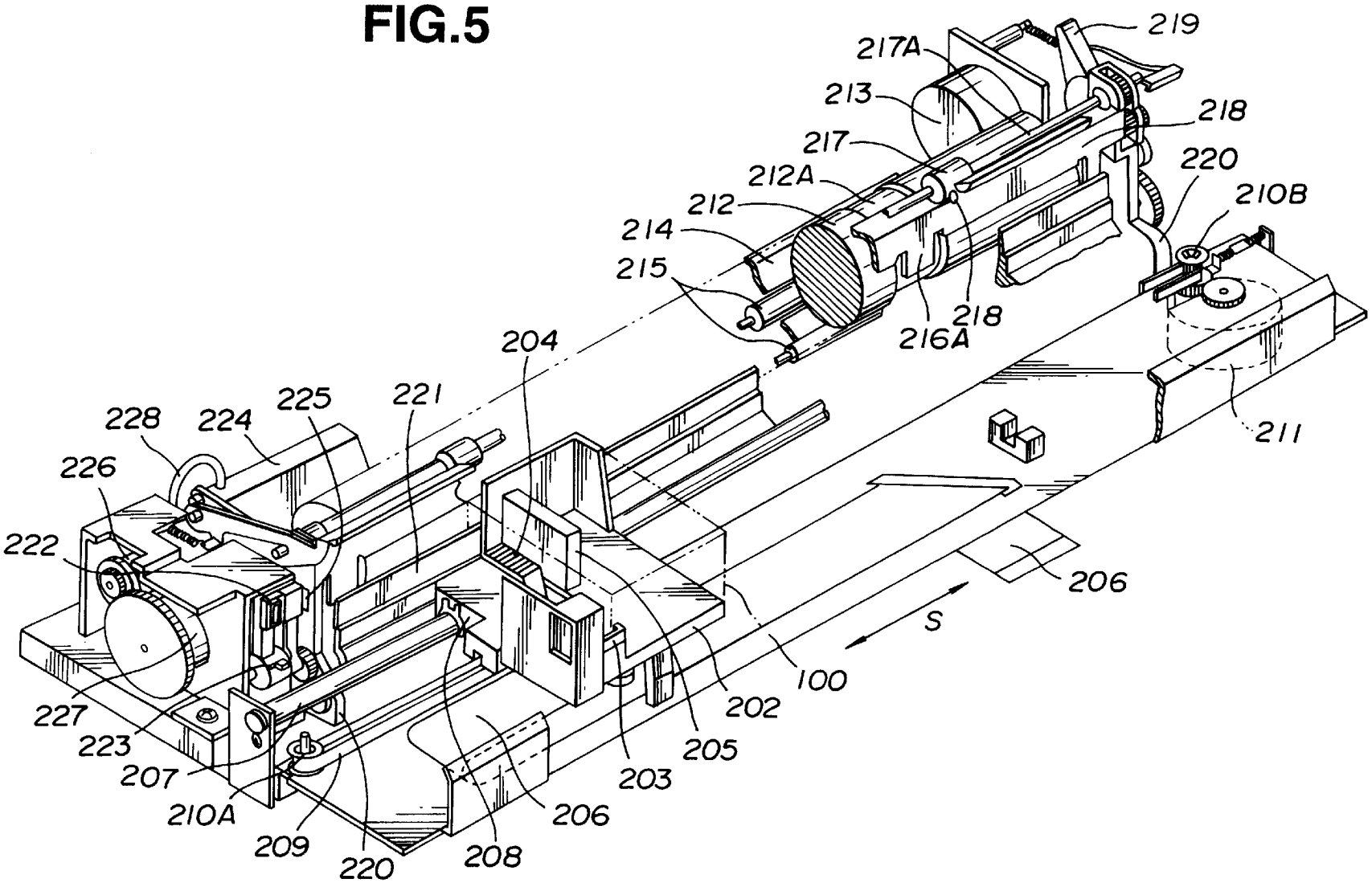
FIG. 5 is a perspective view illustrating a printer unit of an ink-jet recording apparatus to which the present invention can be applied.

FIG. 5 is a perspective view of the printer. In FIG. 5, there are shown the head cartridge 100 having the above-described ink-jet recording head, and a carriage 202 for performing scanning in the directions of a two-headed arrow S in a state of mounting the head cartridge 100. There are also shown a hook 203 for mounting the head cartridge 100 on the carriage 202, and a lever 204 for operating the hook 203. A supporting plate 205 supports an electrical connection unit connected to the head cartridge 100. Reference numeral 206 is an FPC (flexible printed circuit) for connecting the electrical connection unit to a control unit of the main body of the apparatus. A guide shaft 207 for guiding the carriage 202 in the directions of the two-headed arrow S is threaded in a bearing 208 of the carriage 202. A timing belt 209 connected to the carriage 202 in order to transmit the motive power for moving it in the directions of the two-headed arrow S is stretched between pulleys 210A and 210B disposed at two side portions of the apparatus. A driving force is transmitted from a carriage motor 211 to the pulley 210B via a transmission mechanism comprising gears or the like. A conveying roller 212 for conveying a recording medium, such as paper or the like, while regulating the recording surface of the recording medium in a recording operation or the like is driven by a conveying motor 213. A paper pan 214 guides the recording medium to a recording position. Pinch rollers 215 are disposed in the mid-course of the conveying path of the recording medium in order to press the recording medium against the conveying roller 212 for providing the recording medium with a conveying force, A platen 216 faces the position of the discharging ports of the head cartridge 100, and regulates the recording surface of the recording medium by pressing the recording medium against a leading-edge portion 221 of the paper pan 214 from the back of the recording medium. A sheet-discharging roller 217 is disposed at a side downstream from the recording position in the conveying direction of the recording medium in order to discharge the recording medium toward a sheet-discharging port (not shown). A spur 218 in contact with the sheet-discharging roller 217 provides a conveying force for the recording medium by the sheet-discharging roller 217 by pressing the sheet-discharging roller 217 via the recording medium. A release lever 219 releases the pressing forces of the pinch rollers 215 and the spur 218 when, for example, setting a recording medium.

A cap 222 made of an elastic material, such as rubber or the like, faces the surface of the recording head, where the ink-discharging ports are formed, at a home position, and is supported so as to be contactable/detachable relative to the recording head. The cap 222 is used when the recording head must be protected, for example, while recording is not performed, and in discharge recovery processing of the recording head.

The discharge recovery processing indicates processing of removing factors causing failures in a discharging operation, such as bubbles, dust, or ink unsuitable for recording due to an increase in the viscosity, by discharging ink from all of the discharging ports by driving energy-generating elements used for ink discharge provided in the vicinity of the ink discharging ports in a state in which the cap 222 faces the surface where the discharging ports are formed (a preliminary discharging operation), or processing of removing factors causing failures in a discharging operation by forcibly sucking and discharging ink from the discharging ports in a state in which the surface where the discharging ports are formed is covered by the cap 222.

A pump 223 produces a sucking force for forcibly discharging ink, and is also used for sucking ink received in the cap 222 in the above-described discharge recovery processing. A waste-ink tank 224 stores waste ink sucked by the pump 223. The waste-ink tank 224 is connected to the pump 223 via a tube 228.

A blade 225 is used for wiping the discharging-port-forming surface of the recording head, and is supported so as to be movable between a position where a wiping operation is performed while the carriage 201 moves in a state of protruding toward the recording head, and a retracted position where the blade 225 is not in contact with the the discharging-port-forming surface of the recording head.

The mechanism comprising the pump 223, the cap 222, the blade 225 and the like is termed a recovery system. Reference numeral 226 represents a recovery-system motor. A cam device 227 drives the pump 223 and moves the cap 222 and the blade 225 by a motive force transmitted from the recovery-system motor 226.

Figure 6:
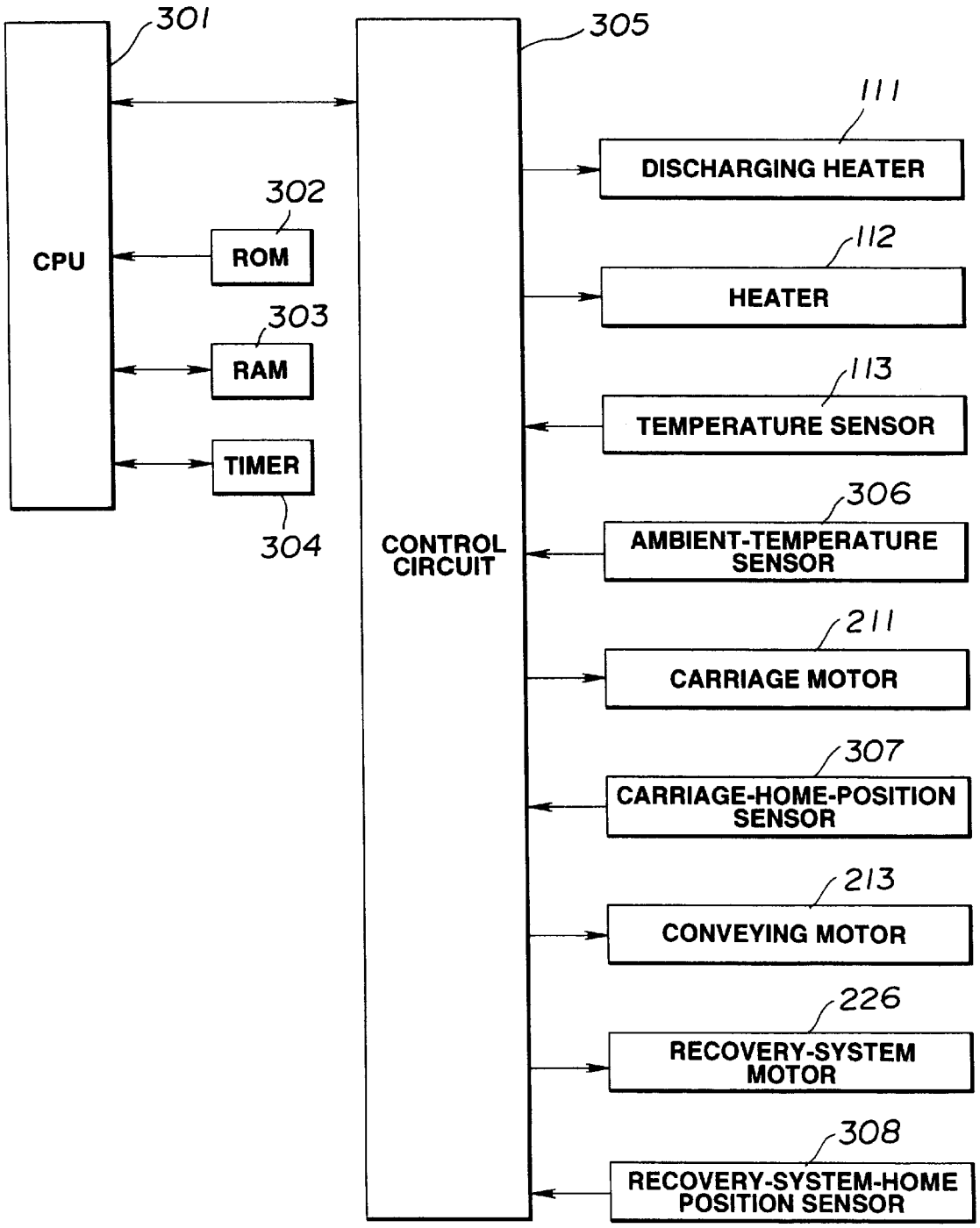
FIG. 6 is a block diagram illustrating the configuration of control of the ink-jet recording apparatus shown in FIG. 5.

FIG. 6 is a block diagram illustrating the configuration of control of the above-described ink-jet recording apparatus. In FIG. 6, a CPU 301 executes various kinds of processing based on preset programs. A ROM (read-only memory) 302 stores various kinds of data, such as programs to be executed by the CPU 301, correspondence tables of numerical values, and the like. A RAM (random access memory) 303 is used as work areas when the CPU 301 executes processing. A timer 304 measures timings of various kinds of processing. A control circuit 305 performs various kinds of controls in accordance with signals from the CPU 301. An ambient-temperature sensor 306 detects the ambient temperature. A carriage-home-position sensor 307 detects a reference position of the carriage 202 in the scanning direction. A recovery-system-home-position sensor 308 detects a reference position of the cam device 227 of the recovery system.

First Embodiment

A description will now be provided of control of the amount of ink discharge of the recording head according to a first embodiment of the present invention.

Figure 7:
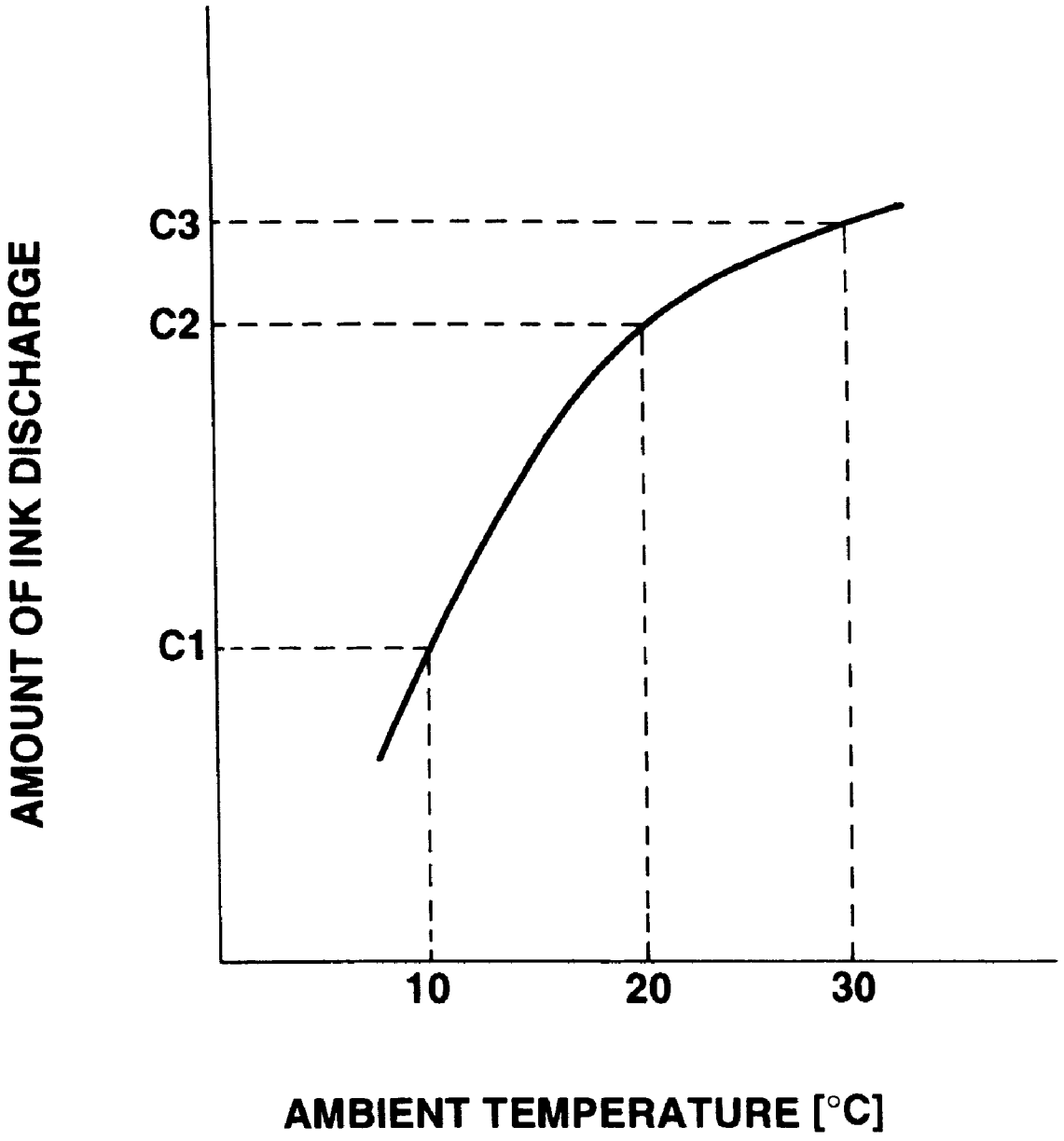
FIG. 7 is a graph illustrating an example of the relationship between the amount of ink discharge and the ambient temperature in a first embodiment of the present invention.

FIG. 7 is a graph illustrating an example of the relationship between the amount of ink discharge (i.e., recording density) and the ambient temperature. In FIG. 7, if the guaranteed operating temperature range of the recording apparatus is assumed to be between 10° C. and 30° C., the amount of ink discharge changes between C1 and C3 depending on the ambient temperature. If it is assumed that the recording head is configured to perform optimum recording with the amount of ink discharge C2 at 20° C., it is desirable that the amount of ink discharge remains in the vicinity of C2 irrespective of the ambient temperature. Accordingly, a control can be considered in which variations in the amount of ink discharge are suppressed within a small range between C2 and C3 by heating the proximity of the nozzles of the recording head to 20° C. when the ambient temperature is less than 20° C.

Such a control may be performed, for example, by heating the proximity of the nozzles of the recording head to 20° C. by driving the heater 112 before starting recording of each line, and thereafter starting the recording. In general, in the driving sequence of the heater, in order to prevent a decrease in the throughput, the heater 112 is simultaneously driven during acceleration and preliminary running of the carriage 202 so that the driving of the heater 112 is completed before starting the recording.

In order to realize the above-described approach by performing open-loop sequence control, the proximity of the nozzles of the recording head may be heated in accordance with the ambient temperature so that the temperature is raised by the temperature difference between 20° C. and the ambient temperature. In open-loop predictive control, it becomes unnecessary to detect the temperature of the recording head while controlling acceleration of the carriage. Hence, control is simplified, and optimum acceleration conditions can be predicted. As a result, high-speed recording can be realized. For that purpose, in the present embodiment, the relationship between the driving time period of the heater and the temperature rise in the proximity of the nozzles of the recording head is checked in advance.

Figure 8:
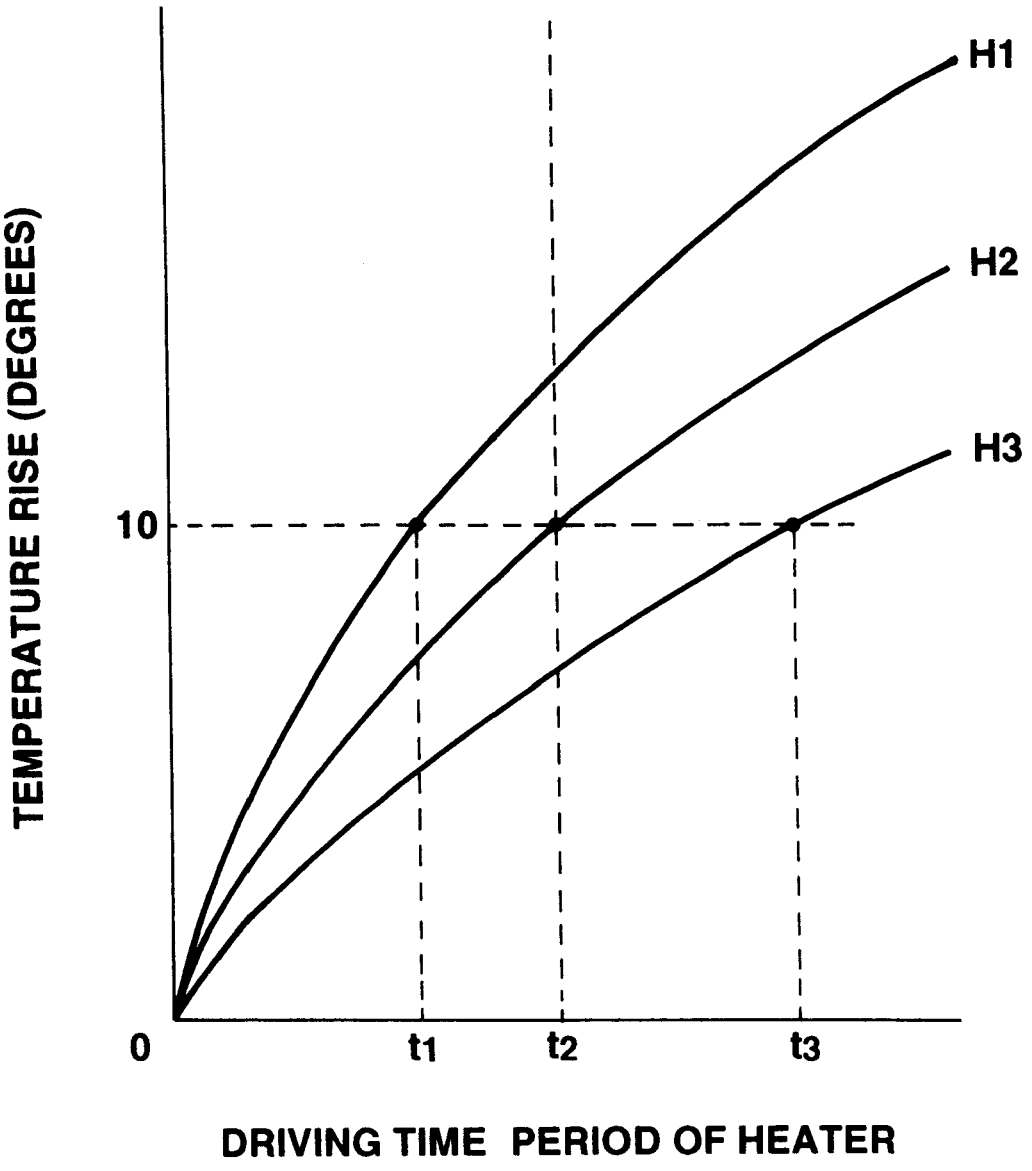
FIG. 8 is a graph illustrating an example of the relationship between the driving time period of a heater and temperature rise in the proximity of nozzles of a recording head in the first embodiment.

FIG. 8 is a graph illustrating an example of the relationship between the driving time period of the heater and temperature rise in the proximity of the nozzles of the recording head. In general, since variations are present in temperature characteristics of produced recoding heads, the above-described relationship differs for each recording head. In FIG. 8, a curve H2 represents a recording head having average temperature characteristics, a curve H1 represents a recording head having such temperature characteristics that its temperature can be easily raised (i.e., it is difficult to radiate heat), and a curve H3 represents a recording head having such temperature characteristics that its temperature is difficult to raise (i.e., it is easy to radiate heat). These temperature characteristics are little influenced by the ambient temperature. It can be considered that variations in the temperature characteristics are caused by differences in the heating value due to variations in the resistance value of the heater 112, differences in the thermal conductivity due to variations in materials of the heater board 110, the base plate 130 and the like, differences in the heat capacity due to variations in the dimensions, differences in the thermal conductivity due to variations in the thickness of the adhesive layer between the heater board 110 and the base plate 130, and the like.

A description will now be provided of a method of determining the driving time period of the heater 112 when the ambient temperature is 10° C. in a conventional approach with reference to FIG. 8. In this case, since the temperature difference between the target temperature 20° C. and the ambient temperature is 10 degrees, the driving time period of the heater 112 may be determined so that the temperature of the proximity of the nozzles of the recording head is raised by 10 degrees. In general, the driving time period is set to t2 based on a recording head having the average temperature characteristics (the curve H2). In this case, however, if a recording head having the temperature characteristics of the curve H1 is mounted, the temperature rise in the proximity of the nozzles exceeds 10 degrees. Accordingly, the amount of ink discharge exceeds the optimum value, so that ink is consumed more than necessary and the running cost increases. In order to overcome this problem, the driving time must be set to t1 based on the recording head having the temperature characteristics of the curve H1. In this case, however, if a recording head having the temperature characteristics of the curve H3 is mounted, the temperature rise in the proximity of the nozzles of the recording head is considerably smaller than the target value, so that the control effect can be hardly expected.

In order to overcome the above-described problems, the driving time may be set to t1, t2 and t3 when the temperature characteristics of the recording head correspond to the curves H1, H2 and H3, respectively. In order to realize such an approach, the present embodiment has a feature in that the temperature characteristics of the recording head can be detected with a simple configuration in the following manner.

First, temperature-characteristic curves as shown in FIG. 8, in which variations in temperature characteristics of produced recording heads are considered, are obtained in advance. Such curves can be obtained by sampling a certain number of recording heads of different production lots, obtaining measured data of temperature characteristics of these recording heads, and performing statistical processing of the data. Suppose that as the result of the measurement, as shown in FIG. 8, the upper limit and the lower limit of the curves of the measured data equal the curve H1 and H3, respectively.

In order to detect temperature characteristics of the recording head by a recording apparatus, temperature rise in the proximity of the nozzles of the recording head when the heater 112 is driven for a predetermined time period may be measured by the temperature sensor 113. For example, if temperature rise when the heater 112 is driven for a time period t1 is 10 degrees, it can be understood that the temperature characteristics of the recording head correspond to the curve H1. In this temperature measurement, since a temperature change (relative temperature) is measured instead of the actual temperature (absolute temperature), the problems, which have been described in the conventional approach, in temperature detection caused by variations in temperature sensors do not arise. In addition, as described above, the temperature sensor 113 can be easily manufactured on the heater board 110 by the semiconductor film forming technique.

Figure 9:
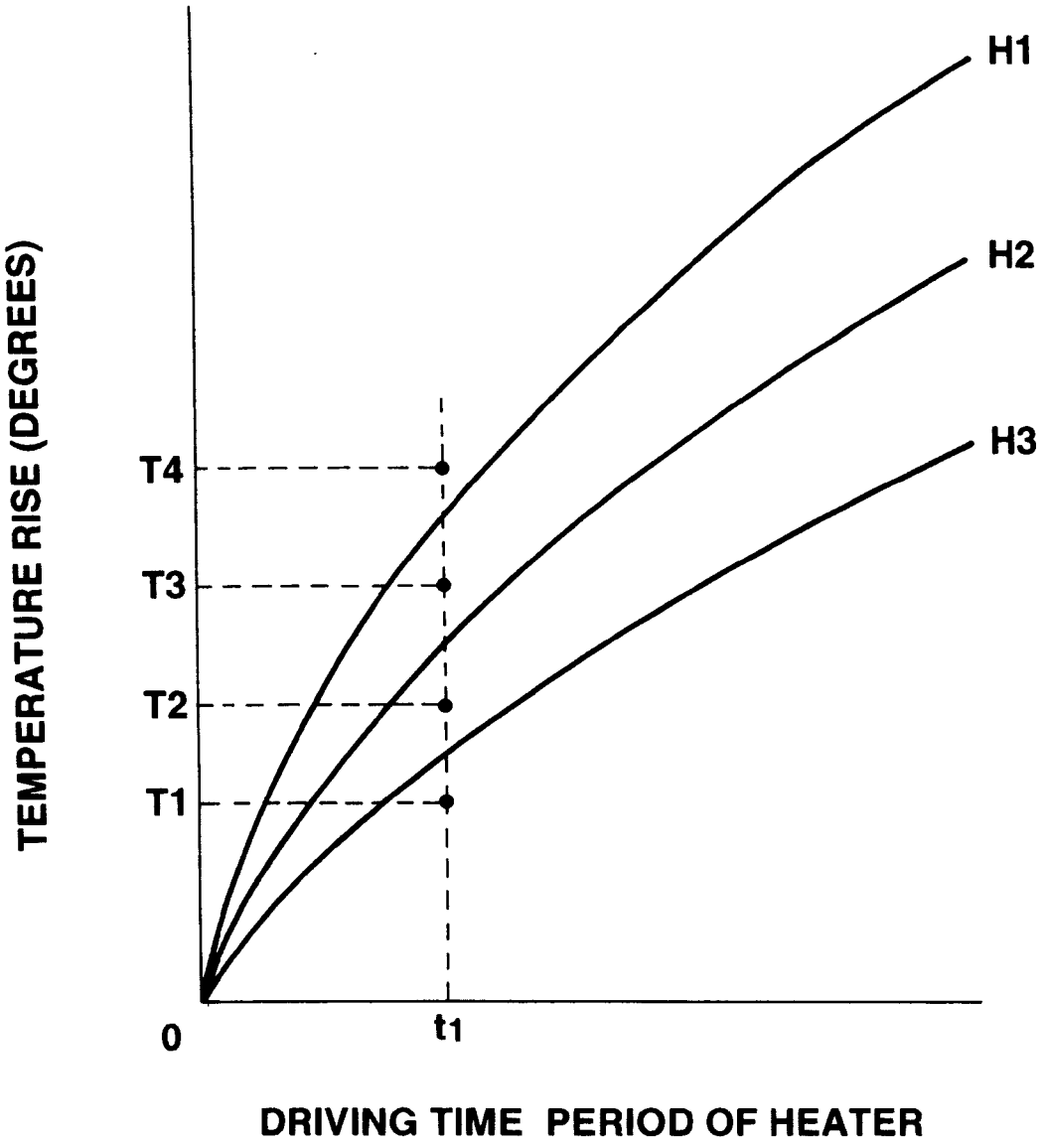
FIG. 9 is a diagram illustrating an operation of ranking temperature characteristics according to temperature-characteristic curves in the first embodiment.

A description will now be provided of a method for determining the optimum driving time period of the heater in accordance with the temperature characteristics of the recording head. As shown in FIG. 9, values of temperature rise T1, T2, T3 and T4 are set for the same temperature characteristic curves as those shown in FIG. 8. As shown in FIG. 10, a correspondence table between the values of temperature rise and the temperature characteristics of the recording head when the heater 112 is driven for a time period t1 can be obtained from FIG. 9. Then, from FIG. 8, the driving time period of the heater for each of the temperature characteristic curves H1, H2 and H3 is determined for each value of the ambient temperature. For example, when the ambient temperature equals 10° C., the driving time periods may be determined as t1, t2 and t3 for the temperature characteristics H1, H2 and H3, respectively, in order to raise the temperature by 10 degrees to the target temperature 20° C. Similarly, the driving time periods may be determined as t11–t1, t21–t29, and t31–t39 for other values of the ambient temperature. Thus, as shown in FIG. 11, a table for determining driving time periods of the heater for respective combinations of the ambient temperature and the temperature characteristics of the recording head can be provided.

Figure 12:
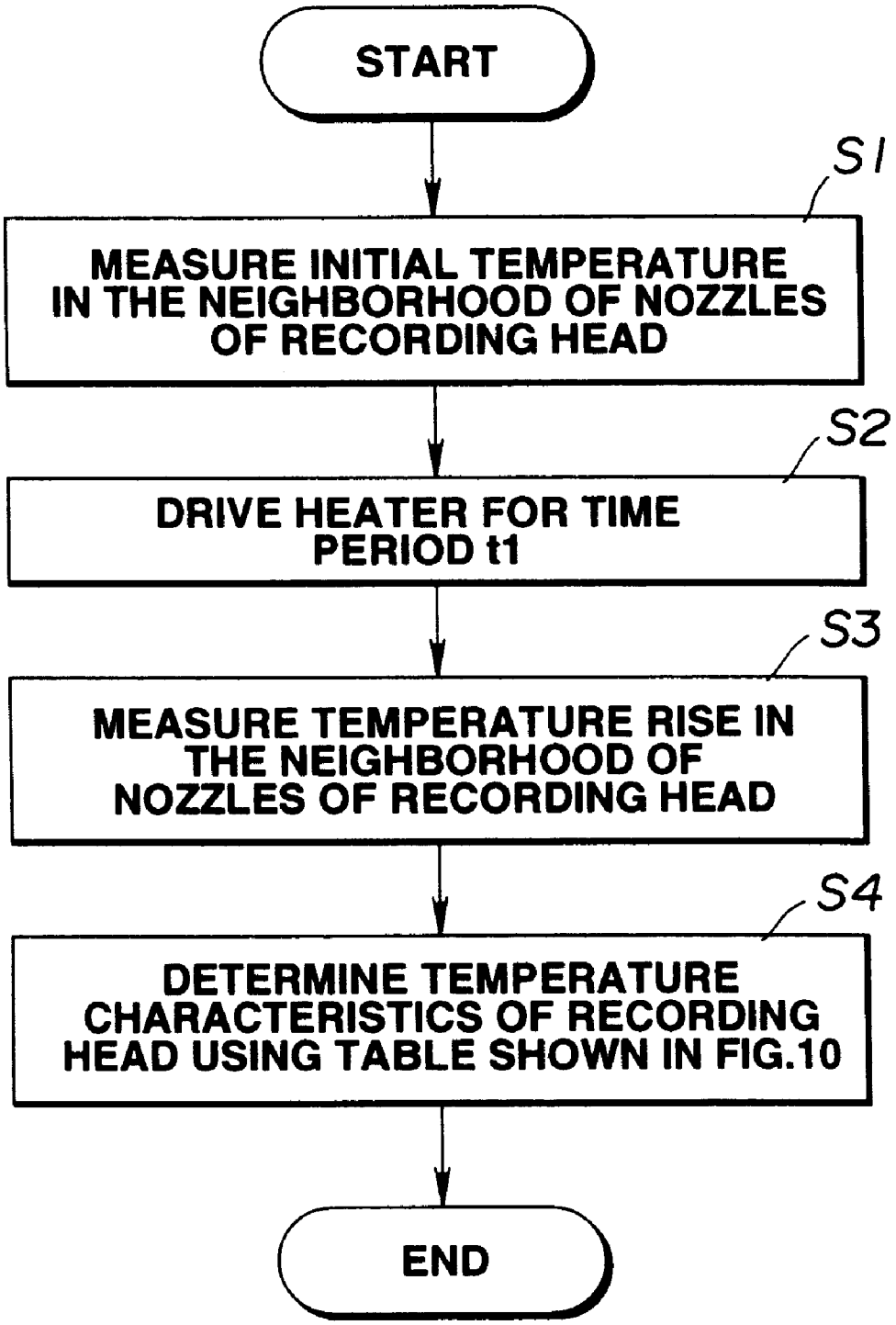
FIG. 12 is a flowchart for detecting the temperature characteristics of the recording head in the first embodiment.

FIG. 12 illustrates a flowchart for detecting temperature characteristics of the recording head. In step S1, the initial temperature in the proximity of the nozzles of the recording head is measured. In step S2, the heater 112 is driven for a predetermined time period (t1). In step S3, the value of temperature rise in the proximity of the nozzles of the recording head from the initial temperature caused by the driving is measured. In step S4, the temperature characteristics of the recording head corresponding to the value of temperature rise are determined using the table shown in FIG. 10. The temperature measurement in steps S1 and S3 is performed using the output values of the temperature sensor 113. The driving time period t1 of the heater 112 for detecting the temperature characteristics of the recording head in step S2 is determined depending on the number of required ranks of the temperature characteristics and the capability of detecting a temperature change of the temperature sensor 113. Control accuracy can be increased as the number of ranks increases. The temperature width for one rank decreases as the number of ranks increases. Hence, if the temperature width is smaller than the detection capability of the temperature sensor 113, the temperature width of one rank must be increased by increasing the driving time period of the heater 112. However, since temperature rise in the recording head when detecting the temperature characteristics increases as the driving time period increases, it, is not preferable to increase the driving time period more than necessary.

Figure 13:
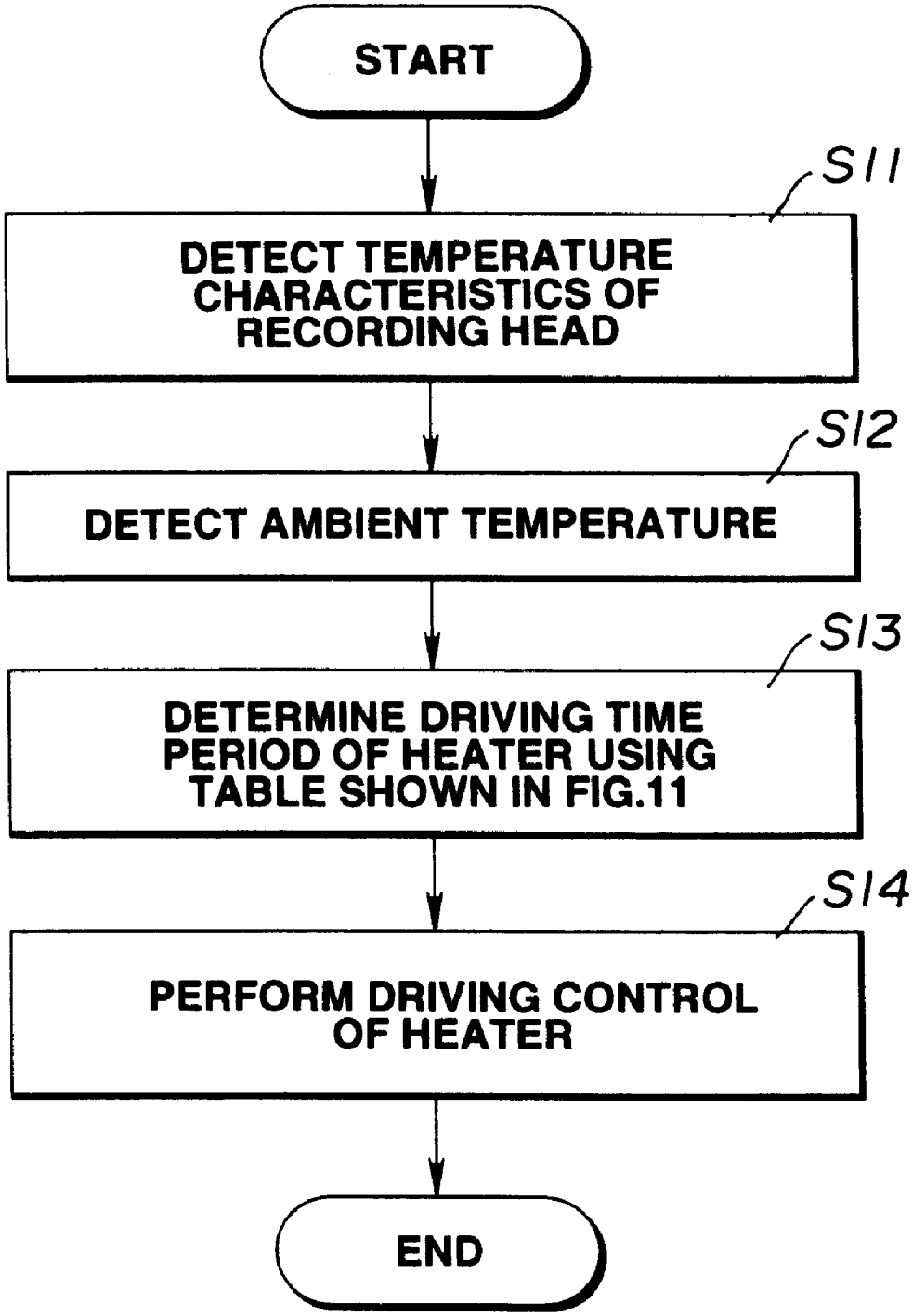
FIG. 13 is a flowchart for controlling the amount of ink discharge of the recording head in the first embodiment.

FIG. 13 illustrates a flowchart for controlling the amount of ink discharge of the recording head in the present embodiment. In step S11, the temperature characteristics of the recording head are detected according to the flowchart for detecting the temperature characteristics shown in FIG. 12. In step S12, the ambient temperature is detected. In step S13, the driving time period of the heater 112 is determined from the table shown in FIG. 11 in accordance with the temperature characteristics of the recording head and the ambient temperature. In step S14, the heater 112 is driven for the determined time period. The detection of the temperature characteristics of the recording head in step S11 is generally performed when the power supply of the recording apparatus is turned on or when exchanging the head catridge, but may be performed at any appropriate time before starting recording whenever necessary.

Although in the present embodiment, as shown in FIG. 11, the temperature characteristics of the recording head are classified into three ranks, the number of ranks may be increased or decreased whenever necessary. Although the step of the ambient temperature is set to one degree, any other step may be set whenever necessary.

Although in the present embodiment, the target temperature is set to 20° C., the targets temperature is not limited to this value, but another value may be determined from the relationship between the ambient temperature and the amount of ink discharge shown in FIG. 7 whenever necessary.

Although in the present embodiment, a case, in which driving control of the heater 112 is performed before starting recording of each line, has been illustrated, any other approach may be adopted. For example, driving control of the heater 112 may be performed before starting recording of each page, or a control, in which the recording head is maintained at an appropriate temperature by appropriately driving the heater 112 while the power supply is turned on, may be performed. Also in such driving control of the heater 112, the method of the present embodiment can be applied without modification by obtaining variations in the temperature characteristics as shown in FIG. 8 in accordance with the driving sequence of the heater 112.

Second Embodiment

In a second embodiment of the present invention, discharging heaters are used as means for controlling the amount of ink discharge in control of the amount of ink discharge in which temperature characteristics of the recording head are taken into consideration. In the present embodiment, the heater 112 in the configuration of the first embodiment, is not necessarily used, but may be used together with the discharging heaters.

Figures 14A, 14B, 14C:
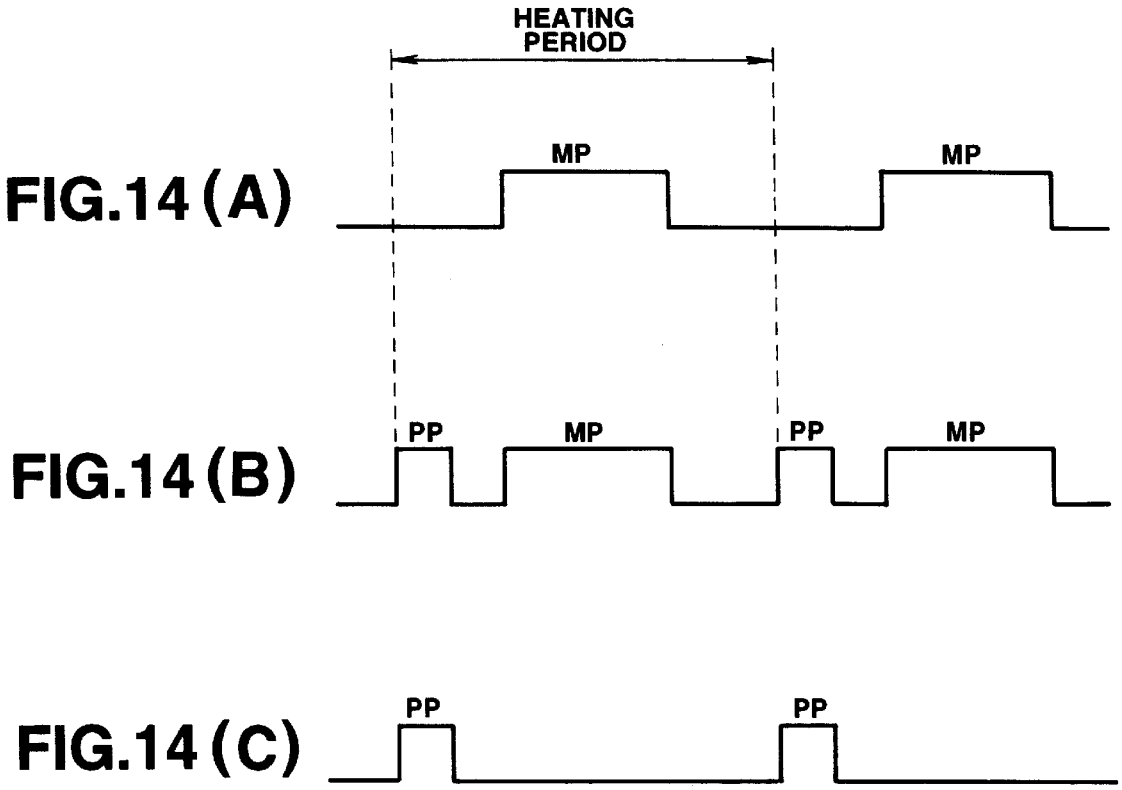
FIGS. 14(A) through 14(C) are diagrams illustrating driving pulses for a discharging heater in a second embodiment of the present invention.

FIGS. 14(A) through 14(C) illustrate examples of driving pulses for a discharging heater. FIG. 14(A) illustrates ordinary dicharging driving pulses which are termed main pulses (MP's). FIG. 14(B) illustrates a case in which a prepulse (PP) is applied with an appropriate quiescent period before applying a main pulse. By changing the application time period of the prepulse, the amount of ink discharge can be changed. FIG. 14(C) illustrates an example of driving pulses for detecting temperature characteristics of the recording head (to be described later).

If the relationship between the amount of ink discharge and the ambient temperature is the same as that shown in FIG. 7 in the first embodiment, variations in the amount of ink discharge due to the ambient temperature can be suppressed within a small range between C1 and C2 as in the first embodiment by controlling the application time period of the prepulse when the ambient temperature is less than 20° C.

Figure 15:
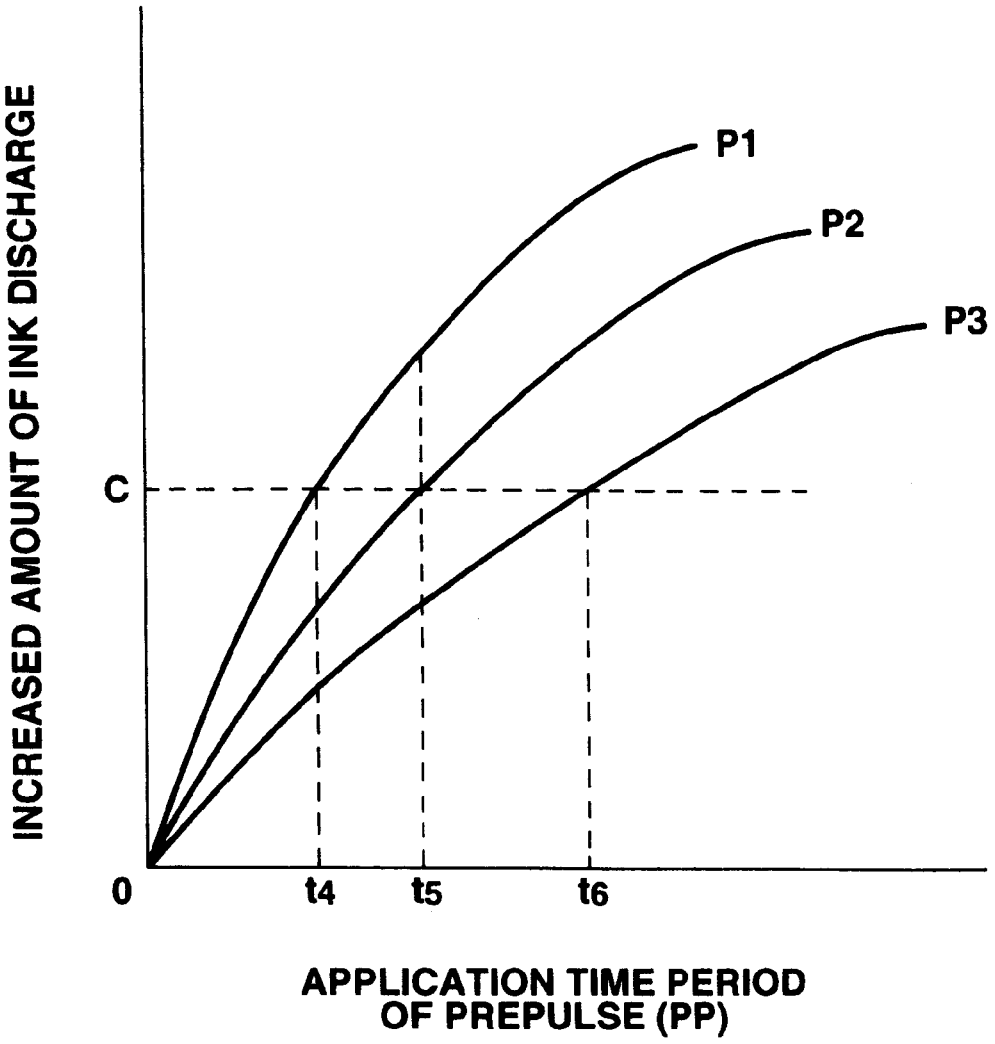
FIG. 15 is a graph illustrating the relationship between the time period of application of a prepulse and an increased amount of ink discharge in the second embodiment.

FIG. 15 is a graph illustrating the relationship between the application time period of the prepulse and the increased amount of ink discharge. As shown in FIG. 15, the amount of ink discharge can be increased by increasing the prepulse application time period. This is because ink in the proximity of the nozzles of the recording head becomes more easily discharged by being heated by the discharging heater to which the prepulse has been applied. This relationship is little influenced by the ambient temperature.

However, since variations are generally present in temperature characteristics of produced recording heads, the above-described relationship differs for each recording head. In FIG. 15, a curve P2 represents a recording head having average temperature characteristics, a curve P1 represents a recording head having such temperature characteristics that its temperature can be easily raised (i.e., it is difficult to radiate heat), and a curve P3 represents a recording head having such temperature characteristics that it is difficult to raise its temperature (i.e., it is easy to radiate heat).

Figure 21:
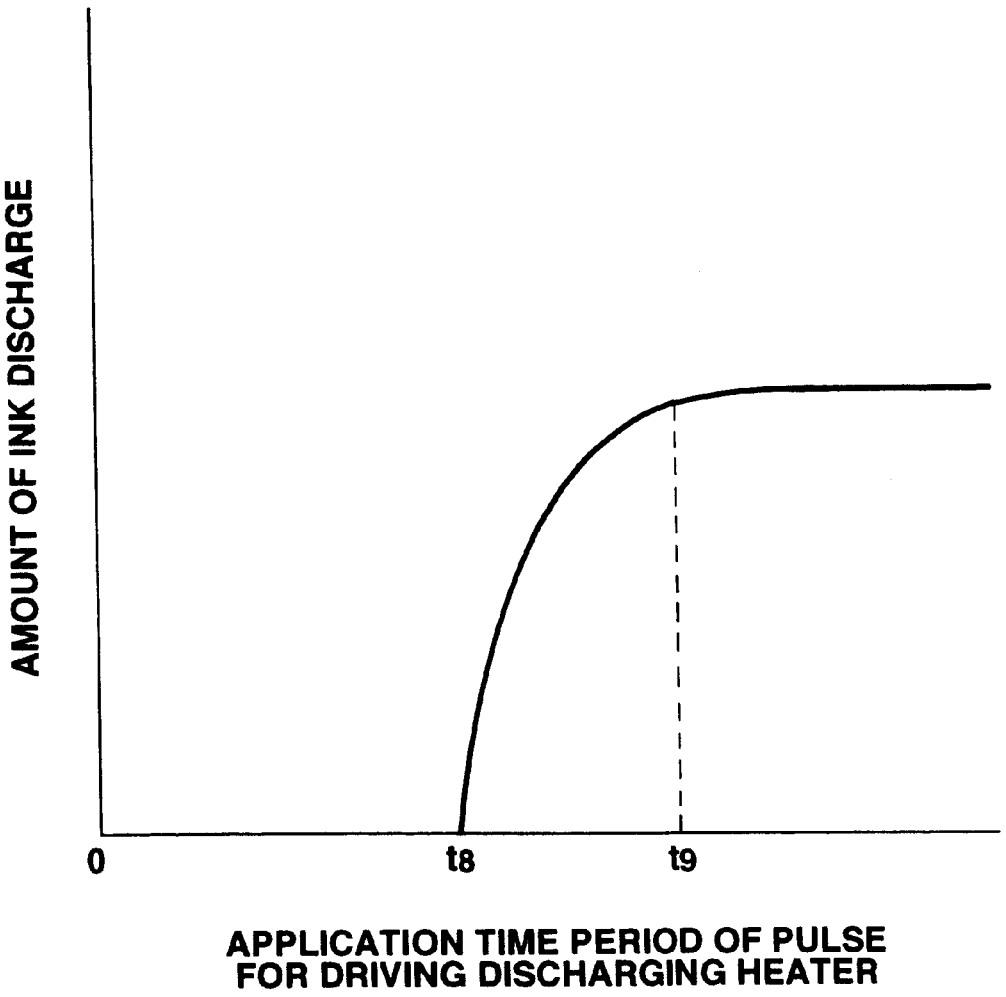
FIG. 21 is a graph illustrating the relationship between the time period of application of a discharging-heater driving pulse and the amount of ink discharge.

An additional description will now be provided of the application time period of the prepulse. FIG. 21 is a graph illustrating the relationship between the application time period of the pulse for driving the discharging heater and the amount of ink discharge. When the application time period is increased, ink discharge starts at a time t8. Then, the amount of ink discharge increases and substantially saturates in the vicinity of a time t9. This is because energy more than a predetermined value is necessary in order to discharge ink by generating a bubble by film boiling of the ink. Accordingly, the prepulse application time period must be set within a range shorter than the time t8 so as not to discharge ink. Since ink discharge is unstable between the time t8 and the time t9, the main-pulse application time period is generally set to a value greater than the time t9.

A description will now be provided of a method for determining the prepulse application time period when the ambient temperature equals 10° C. in a conventional approach. In this case, the prepulse application time period may be determined from FIG. 7 so that the amount of ink discharge increases by the difference C2−C1 (represented by C) between the amount of ink discharge C2 at the target temperature 20° C. and the amount of ink discharge C1 at the ambient temperature.

In general, the prepulse application time period is set to t5 based on a recording head having the average temperature characteristics (the curve P2) shown in FIG. 15. In this case, however, if a recording head having temperature characteristics of the curve P1 is mounted, the increased amount of ink discharge of the recording head exceeds the target value C. Accordingly, the amount of ink discharge exceeds the optimum value, so that ink is consumed more than necessary and the running cost increases. In order to overcome this problem, the driving time must be set to t4 based on the recording head having the temperature characteristics of the curve P1. In this case, however, if a recording head having temperature characteristics of the curve P3 is mounted, the increased amount of ink discharge of the recording head exceeds the target value C, so that the control effect can be hardly expected.

In order to overcome the above-described problems, the driving time may be set to t4, t5 and t6 when the temperature characteristics of the recording head correspond to the curves P1, P2 and P3, respectively. In order to realize such an approach, the present embodiment has a feature in that temperature characteristics of the recording head can be detected with a simple configuration in the following manner.

First, temperature characteristics of the recording head when applying a prepulse can be detected as temperature characteristics of the recording head when driving the discharging heater as a heat source, i.e., the amount of temperature rise of the recording head when driving the discharging heater. However, if the discharging heater is driven by a main pulse in an ordinary manner, temperature rise caused by the driving influences the discharging state of ink. This is because a considerable heat quantity is taken from the recording head when ink is discharged outside the recording head. Temperature rise at that time has a maximum value when ink is not filled within the nozzles for some reason and therefore is not discharged, and has a minimum value when the ink is discharged in an optimum state. That is, in order to detect temperature characteristics of the recording head from the value of temperature rise at that time, the discharging state of the ink must be specified. Accordingly, in the present embodiment, in order to detect temperature characteristics of the recording head without being influenced by the discharging state of ink, the discharging heater is driven so as not to discharge ink, and the value of temperature rise of the recording head caused by the driving is measured, whereby temperature characteristics of the recording head are detected.

Figure 16:
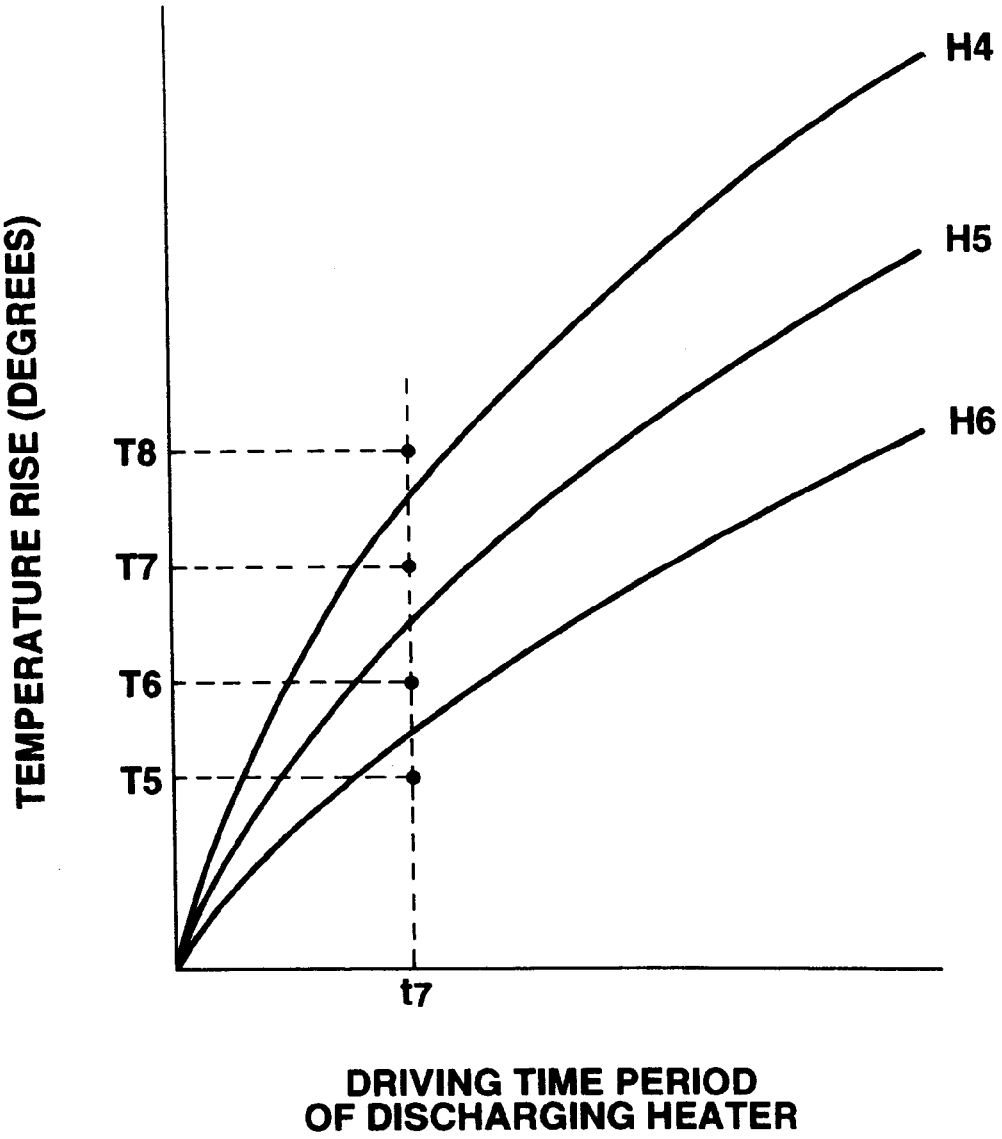
FIG. 16 is a diagram illustrating an operation of ranking temperature characteristics according to temperature-characteristic curves in the second embodiment.

In order to drive the discharging heater so as not to discharge ink, the discharging heater may be driven, as described with reference to FIG. 21, by a driving pulse shorter than the time t8. For that purpose, for example, as shown in FIG. 14(C), only prepulses may be periodically applied for a predetermined time period. FIG. 16 illustrates temperature rise in the recording head at that time. In FIG. 16, curves H4, H5 and H6 correspond to cases having discharging characteristics of the curves P1, P2 and P3 shown in FIG. 15, respectively. As shown in FIG. 16, temperature rise when driving the discharging heater for a predetermined time period (t7) is ranked according to values of temperature rise T5, T6, T7 and T8. Then, as shown in FIG. 17, a correspondence table between temperature rise and temperature characteristics of the recording head when the discharging heater 111 is driven for a time period t7 can be provided.

Then, the increased amount of ink discharge required in accordance with the ambient temperature is obtained from FIG. 7, and a required prepulse application time period is determined for each temperature characteristics from FIG. 15. For example, when the ambient temperature equals 10° C., according to FIG. 7, the amount of ink discharge must be increased by C (=C2−C1) in order to provide the amount of ink discharge at the target temperature 20° C. Hence, from FIG. 15, the driving time periods may be determined as t4, t5 and t6 for the temperature characteristics H4, H5 and H6, respectively. Similarly, the driving time periods may be determined as t41–t49, t51–t59, and t61–t69 for other values of the ambient temperature. Thus, as shown in FIG. 18, a table for determining prepulse application time periods for respective combinations of the ambient temperature and the temperature characteristics of the recording head can be provided.

Figure 19:
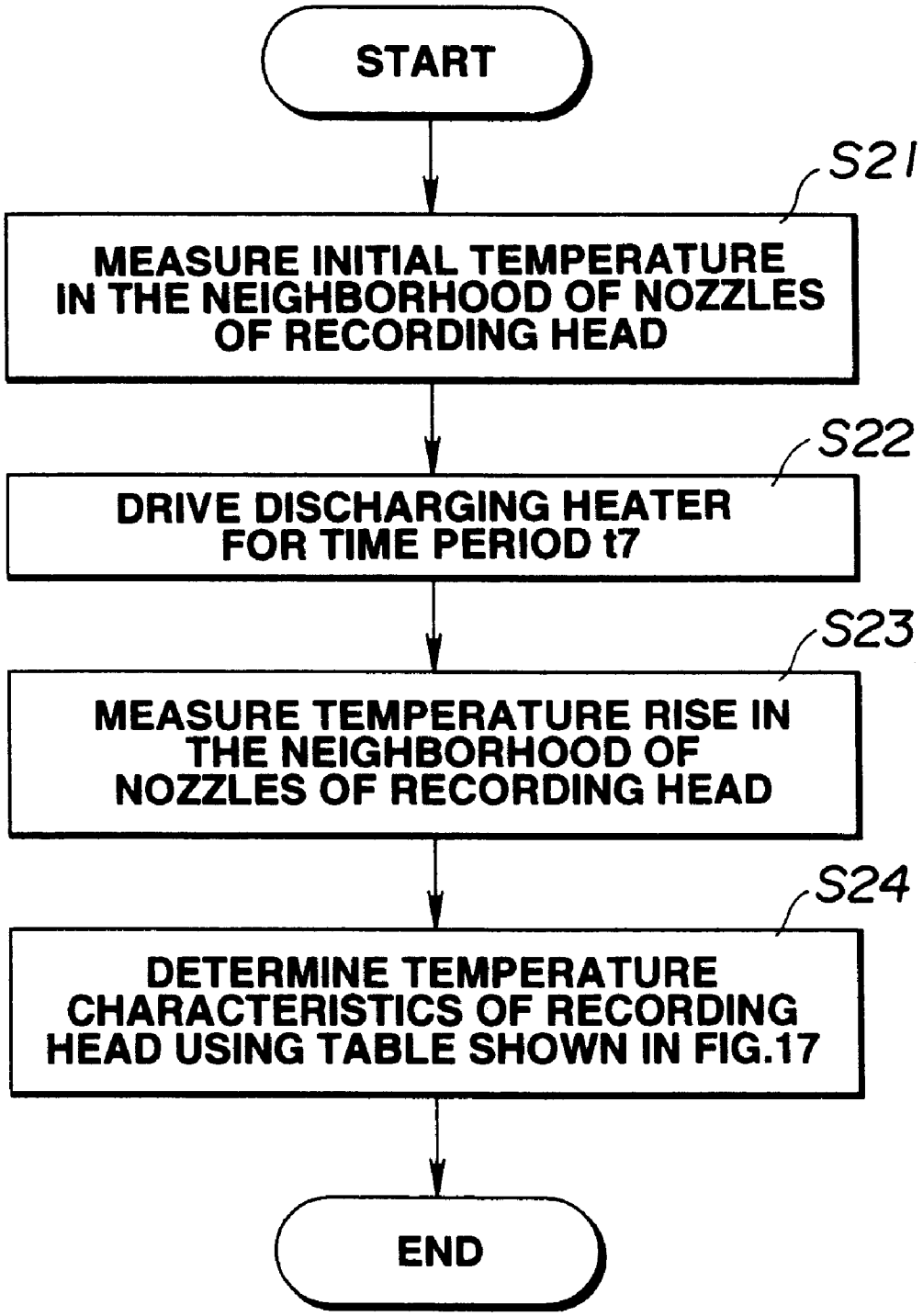
FIG. 19 is a flowchart for detecting the temperature characteristics of the recording head in the second embodiment.

FIG. 19 is a flowchart for detecting temperature characteristics of the recording head. In step S21, the initial temperature in the proximity of the nozzles of the recording head is measured. In step S22, the discharging heater 111 is driven for a predetermined time period (t7). In step S23, the value of temperature rise in the neighborhood of the nozzles of the recording head caused by the driving is measured. In step S24, temperature characteristics of the recording head are determined from the table shown in FIG. 17 in accordance with the measured value of temperature rise. The temperature measurement in steps S21 and S23 and the determination of the driving time period of the discharging heater in step S22 are performed in the same manner as in the case of FIG. 12 in the first embodiment.

Figure 20:
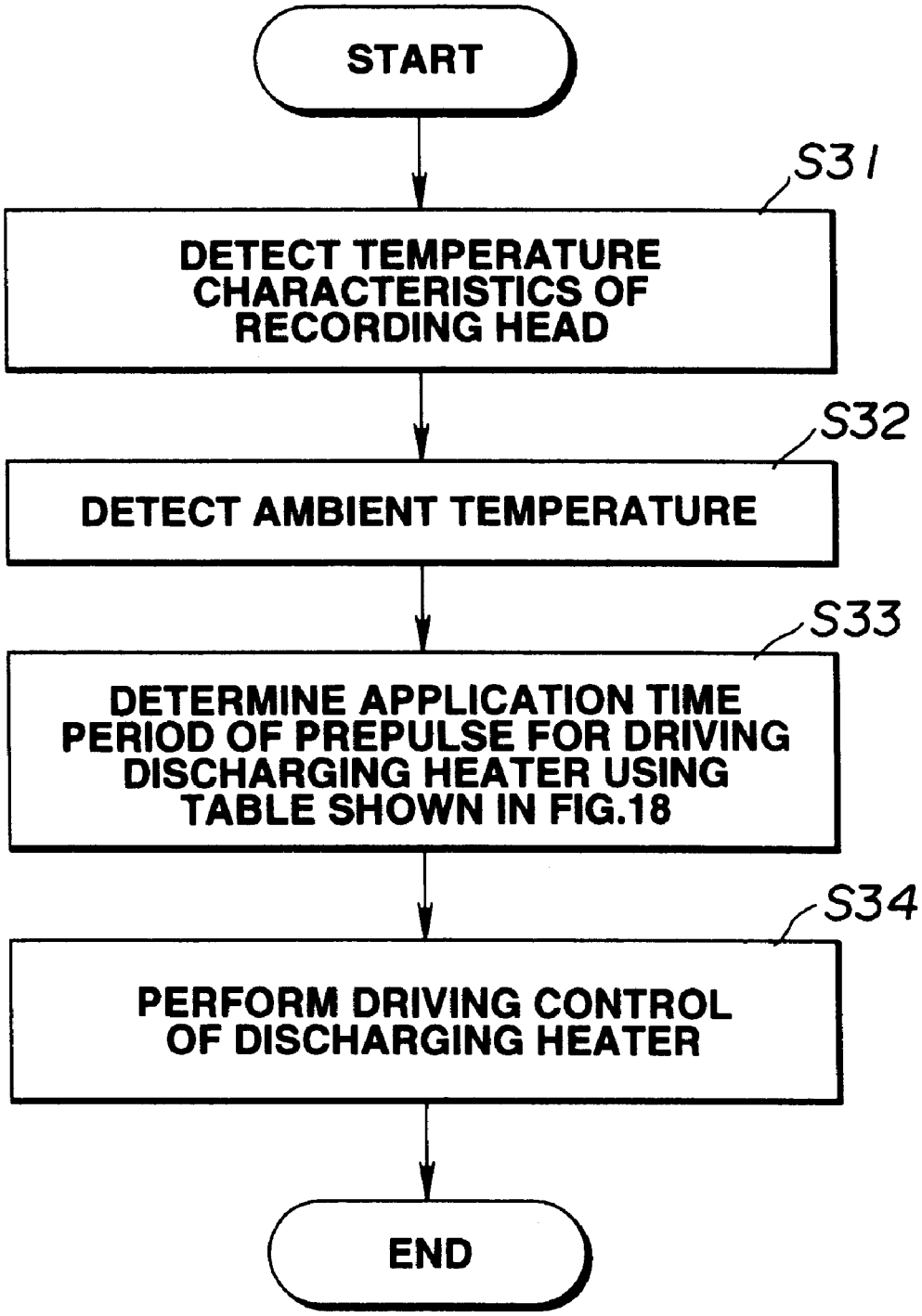
FIG. 20 is a flowchart for controlling the amount of ink discharge of a recording head.

FIG. 20 illustrates a flowchart for controlling the amount of ink discharge of the recording head in the present embodiment. In step S31, temperature characteristics of the recording head are detected according to the flowchart for detecting the temperature characteristics shown in FIG. 19. In step S32, the ambient temperature is detected. In step S33, the prepulse application time period when driving the discharging heater 111 is determined from the table shown in FIG. 18 in accordance with the temperature characteristics of the recording head and the ambient temperature. In step S34, the discharging heater is driven for the determined time period. The detection of the temperature characteristics of the recording head in step S31 is performed in the same manner as in the case of FIG. 13 in the first embodiment.

Although in the present embodiment, as shown in FIG. 17, the temperature characteristics of the recording head are classified into three ranks, the number of ranks may be increased or decreased whenever necessary. Although the step of the ambient temperature is set to one degree, any other step may be set whenever necessary.

Although in the present embodiment, the target temperature is set to 20° C., the target temperature is not limited to this value, but another value may be determined from the relationship between the ambient temperature and the amount of ink discharge shown in FIG. 7 whenever necessary.

Although in the present embodiment, a description has been provided of a case in which in order to detect temperature characteristics of the recording head, the discharging heater is driven so as not to discharge ink, temperature characteristics of the recording head may also be detected by discharging ink in the following manner. As described above, in this case, temperature rise of the recording head differs depending on the state of ink discharge. However, since ink discharge is stable if temperature characteristics of the recording head are detected after performing discharge recovery processing of the recording head, a substantially constant valve of temperature rise can be obtained. Accordingly, by adding a sequence of discharge recovery processing before step S21 of the flowchart for detecting the temperature characteristics shown in FIG. 19, temperature characteristics of the recording head can be detected even if the discharging heater is driven so as to discharge ink. In this case, however, since ink is discharged from the recording head, care must be taken so that the discharged ink does not contaminate the recording apparatus and the like, for example, by causing the nozzles of the recording head to face the cap 222 when detecting the temperature characteristics.

In the first and second embodiments, temperature rise in the recording head is measured when detecting temperature characteristics of the recording head. However, temperature characteristics of the recording head may also be detected in the following manner. That is, in FIG. 9 (or FIG. 16), if the driving is interrupted at the driving time t1 (or t7), the temperature of the recording head thereafter decreases. The temperature effect at that time is determined by temperature characteristics of the recording head as in the case of temperature rise. Accordingly, temperature characteristics of the recording head can also be detected by measuring temperature decrease until a certain time period after interrupting the driving.

The present invention is particularly suitable for use in an ink-jet recording head and recording apparatus in which thermal energy generated by an electrothermal transducer, a laser beam or the like is used to cause a change of state of ink discharge, because high-density pixels and high-resolution recording can be realized.

The typical structure and the operational principle of such devices are preferably the ones disclosed in U.S. Pat. Nos. 4,723,129 and 4,740,796. The principle and structure are applicable to a so-called on-demand-type recording system and a continuous-type recording system. Particularly, however, it is suitable for the on-demand type because the principle is such that at least one driving signal is applied to an electrothermal transducer disposed on a liquid (ink) retaining sheet or liquid channel, the driving signal being enough to provide such a quick temperature rise beyond a departure from nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is discharged through a discharging port to produce at least one droplet. The driving signal is preferably in the form of a pulse, because the development and contraction of the bubble can be effected instantaneously, and therefore, the liquid (ink) is discharged with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 in which the heating portion is disposed at a bent portion, as well as the structure of the combination of the discharging port, liquid channel and the electrothermal transducer as disclosed in the above-mentioned patents. In addition, the present invention is applicable to the structure disclosed in Japanese Patent Laid-Open Application No. 123670/1984 wherein a common slit is used as the discharging port for a plurality of electrothermal transducers, and to the structure disclosed in Japanese Patent Laid-Open Application No. 138461/1984 wherein an opening for absorbing pressure waves of the thermal energy is formed corresponding to the discharging portion. This is because the present invention is effective to perform the recording operation with certainty and at high efficiency regardless of the type of recording head.

In addition, the present invention is applicable to a serial-type recording head wherein the recording head is fixed on the main assembly, to a replaceable chip-type recording head which is connected electrically to the main apparatus and which can be supplied with the ink when it is mounted in the main assembly, or to a cartridge-type recording heart having an integral ink container.

The provisions of the recovery means and/or the auxiliary means for the preliminary operation are preferable, because they can further stabilize the effects of the present invention. Examples of such means include capping means for the recording head, cleaning means therefor, pressure or suction means, and preliminary heating means which may be the electrothermal transducer, an additional heating element, or a combination thereof. Also, means for effecting preliminary discharge (not for the recording operation) can stabilize the recording operation.

As regards the variation of the recording head mountable, it may be a single head corresponding to single-color ink, or may be a plurality of heads corresponding to the plurality of ink materials having different recording colors or densities. The present invention is effectively applied to an apparatus having at least one of a monochromatic mode mainly with black, a multicolor mode with different color ink materials and/or a full-color mode using the mixture of the colors, which may be an integrally formed recording unit or a combination of a plurality of recording heads.

Furthermore, in the foregoing embodiments, the ink has been liquid. It also may be an ink material which is solid below the room temperature but liquid at the room temperature. Since the ink is kept within a temperature range between 30° C. and 70° C., in order to stabilize the viscosity of the ink to provide the stabilized discharge in the usual recording apparatus of this type, the ink may be such that it is liquid within the temperature range when the recording signal in the present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, in response to the application of the recording signal producing thermal energy, the ink is liquefied, and the liqufied ink may be discharged. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Patent Laid-Open Application Nos. 56847/1979 and 71260/1985. The sheet is arranged to face the electrothermal transducers. The most effective one of the techniques described above is the film boiling system.

The ink-jet recording apparatus may be used as an output terminal of an information processing apparatus such as a computer or the like, as a copier combined with an image reader or the like, or as a facsimile apparatus having information transmitting and receiving functions.

As described above, according to the present invention, temperature characteristics of a recording head are detected and the amount of ink discharge of the recording head is controlled based on the detected temperature characteristics. Hence, an appropriate recording density can be maintained within a guaranteed ambient temperature range irrespective of variations in the temperature characteristics of the recording head.

Furthermore, since detection of the temperature characteristics of the recording head is performed based on a temperature change of the recording head, the detection can be very precisely performed without being influenced by variations in temperature sensors.

The individual components shown in outline or designated by blocks in the drawings are all well known in the ink-jet recording apparatus and method arts and their specific construction and operation are not critical to the operation or the best mode for carrying out the invention.

While the invention has been described with reference to the structures disclosed herein, it is not confined to the details set forth and this application is intended to cover such modifications or changes as may come within the purposes of the improvements or the scope of the following claims.

What is claimed is:

1. An ink-jet recording apparatus for performing recording using a recording head for discharging ink onto a recording medium, said apparatus comprising:

ambient-temperature detection means for detecting an ambient temperature;

heating means provided in the recording head;

recording-head-temperature detection means for detecting actual temperature of the recording head;

temperature-characteristics detection means for directly detecting temperature characteristics of the recording head based on a result of detection of an actual temperature change in the recording head caused by predetermined energy applied to said heating means by said recording-head-temperature detecting means; and discharge-amount control means for controlling an amount of ink discharge of the recording head based on the temperature characteristics of the recording head directly detected by said temperature-characteristics detection means and the ambient temperature detected by said ambient-temperature detection means.

2. An apparatus according to claim 1, wherein said heating means comprises an ink discharge heater for discharging ink.

3. An apparatus according to claim 2, wherein said temperature-characteristics detection means applies a prepulse, having energy within such a range that the ink is not discharged, to the ink discharge heater.

4. An apparatus according to claim 3, wherein said temperature-characteristics detection means applies the prepulse to the ink discharge heater a plurality of times.

5. An apparatus according to claim 2, wherein said discharge-amount control means controls the amount of ink discharge of the recording head by changing a pulse width of a prepulse applied to the ink discharge heater before applying a discharge driving pulse, and wherein the prepulse has energy within such a range that the ink is not discharged.

6. An apparatus according to claim 5, wherein said discharge-amount control means includes a pulse-width control table for respective combinations of the temperature characteristics of the recording head and the ambient temperature.

7. An apparatus according to claim 2, further comprising:

recovery means for recovering a discharge state of the recording head, wherein said temperature-characteristics detection means applies a discharge driving pulse to the ink discharge heater after the discharge state of the recording head has been recovered.

8. An apparatus according to claim 1, wherein said heating means comprises a temperature control heater for controlling the temperature of the recording head.

9. An apparatus according to claim 8, wherein said discharge-amount control means controls the amount of ink discharge of the recording head by driving the temperature control heater.

10. An apparatus according to claim 9, wherein said discharge-amount control means includes a driving-time control table for respective combinations of the temperature characteristics of the recording head and the ambient temperature.

11. An apparatus according to claim 1, wherein said discharge-amount control means includes a control table for respective combinations of the temperature characteristics of the recording head and the ambient temperature.

12. An apparatus according to claim 1, wherein the recording head discharges the ink using thermal energy.

13. An apparatus according to claim 1, wherein the recording head is mounted in said apparatus so as to be exchangeable.

14. An apparatus according to claim 13, further comprising:

a carriage for mounting the recording head.

15. An apparatus according to claim 1, further comprising:

conveying means for conveying the recording medium on which recording is performed by the recording head.

16. An apparatus according to claim 1, wherein said apparatus is incorporated in a copying apparatus.

17. An apparatus according to claim 1, wherein said apparatus is incorporated in a facsimile apparatus.

18. An apparatus according to claim 1, wherein said apparatus is incorporated in a computer terminal.

19. An ink-jet recording method for performing recording using a mounted recording head for discharging ink onto a recording medium, said method comprising the steps of:

measuring a first actual temperature of the mounted recording head;

heating the recording head by applying predetermined energy to heating means of the mounted recording head;

measuring a second actual temperature of the mounted recording head after starting the heating;

directly detecting temperature characteristics of the recording head based on the measured first and second actual temperatures of the recording head;

detecting an ambient temperature; and performing recording in a state of controlling an amount of ink discharge of the recording head based on the directly detected temperature characteristics of the recording head and the detected ambient temperature.

20. A method according to claim 19, wherein the recording head discharges the ink using thermal energy.

21. An apparatus according to claim 1, further comprising a power supply, wherein said temperature-characteristics detecting means detects the temperature characteristics when power supply is turned on.

22. An apparatus according to claim 1, wherein said temperature characteristics detecting means detects the temperature characteristics when the recording head is exchanged.

* * * * *

UNITED STATES PATENT AND TRADEMARK OFFICE

CERTIFICATE OF CORRECTION

PATENT NO. : 5,975,669

DATED : November 2, 1999

INVENTOR(S) : NORIYOSHI OHSHIMA

It is certified that error appears in the above-identified patent and that said Letters Patent is hereby corrected as shown below:

COLUMN 6:
Line 54, "the the" should read --the--.

COLUMN 9:
Line 23, "t11-t1," should read --t11-t19,--.

COLUMN 10:
Line 12, "targets" should read --target--.

COLUMN 12:
Line 34, "characteristics" should read --characteristic--.

COLUMN 13:
Line 32, "valve" should read --value--.

Signed and Sealed this

Twenty-sixth Day of September, 2000

*Attest:*

Q. TODD DICKINSON

*Attesting Officer*

*Director of Patents and Trademarks*